United States Patent [19]

Whitfield

[11] Patent Number: 4,465,281

[45] Date of Patent: Aug. 14, 1984

[54] GOLF PRACTICE MAT

[76] Inventor: Robert L. Whitfield, 50 W. 27th Ave., San Mateo, Calif. 94403

[21] Appl. No.: 398,232

[22] Filed: Jul. 14, 1982

[51] Int. Cl.[3] ..... A63B 69/36

[52] U.S. Cl. ..... 273/186 R; 273/183 A

[58] Field of Search ..... 273/186 R, 195 R, 195 A, 273/195 B, 196, 197 R, 197 A, 198

[56] References Cited

U.S. PATENT DOCUMENTS 3,107,920 10/1963 Strunk ..... 273/186 R

*Primary Examiner*—George J. Marlo

*Attorney, Agent, or Firm*—Julian Caplan

[57] ABSTRACT

A mat is provided for practicing golf club swings. The mat is made of longitudinally spaced apart blocks held in staggered rows by wires passing through the opposite ends of the blocks. Select blocks have a slit at one end so the select blocks are not held by the wire at one end and, thus, may be pivoted upward about the wire at the other end to serve as knockdown indicators.

4 Claims, 3 Drawing Figures

GOLF PRACTICE MAT

This invention relates to a new and improved golf practice mat with indicators which may be pivoted to project up from the mat to indicate whether the golfer is slicing or hooking in the event the club strikes one or two of the projections. Conventionally, mats similar to doormats have been used on driving ranges and at home to support a golf ball, so that when the club is swung against the ball it will not damage the club or the floor. The present invention comprises a substantial improvement over such mats.

A conventional doormat, which is usually made of blocks of rubber cut from used vehicle tires held in place by transverse wires, is modified in accordance with the present invention and thus the manufacturing cost of the mat is reduced.

In the present mat, there is a center position for a golf tee. Either a conventional tee or a special tee hereinafter described may be inserted at this central position.

At certain distances from the center position for the tee, four of the blocks used to make up the mat are specially prepared. One end of each of these blocks is detached from one of the wires which hold the mat together, so that the particular block or projection can pivot to an upright position around the wire which hold the other end of the block in position. Cutting one end of each of four blocks in a specified position is the principal fabricating job required.

Two of the blocks are located in front of the tee and two of the blocks are located behind the tee. Furthermore, two of the blocks are on the far side of the tee and two on the near side.

Preferably, the projecting blocks are specially colored. Thus, diagonally opposite blocks have the same color.

Accordingly, in accordance with this invention, the ball is teed up in the center position. The golfer then positions himself in normal stance and swings the club. If any of the projecting blocks is knocked down or touched by the club, this indicates whether the golfer would be slicing or hooking, depending upon the particular color projection which the club touches or knocks down.

In a modification of the invention, neither a tee nor a ball is used. The center block is prepared by cutting one end so that it may be pivotted upward. This block is then pivotted up at about a 30° angle. The golfer then swings the club so that the bottom of the club strikes the center block. If the club is swung properly, the center block will rebound to approximately vertical position.

Other objects of the present invention will become apparent upon reading the following specification and referring to the accompanying drawings in which similar characters of reference represent corresponding parts in each of the several views.

Mat 11 is one of a variety of conventional doormats which has been specially modified in accordance with this invention. Such a conventional mat 11 is made up of a number of rectangular blocks of square cross-section, commonly made of used vehicle tires. Transverse wires 13 are inserted in holes in opposite ends of the blocks 12. As is apparent from FIG. 1, there are gaps between blocks in each row and the gaps in adjacent rows are staggered. This makes the mat flexible and reduces the weight and expense of the mat, among other considerations. The ends of the endmost blocks are spaced apart by spacers 14.

Figure 2:
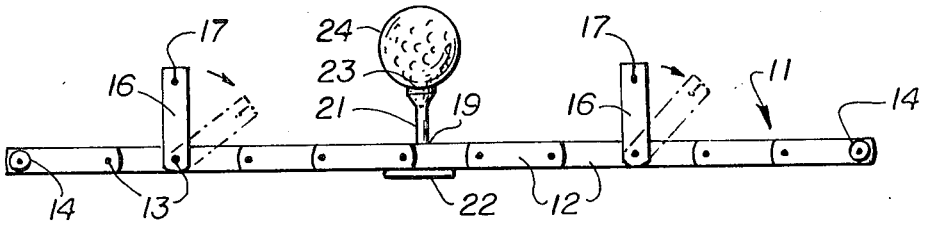
FIG. 2 is a sectional view taken substantially along the line 2—2 of FIG. 1.
Figure 3:
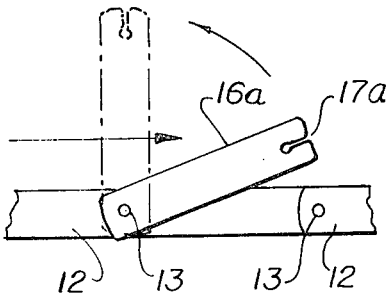
FIG. 3 is an enlarged fragmentary view showing modification of a portion of FIG. 2 showing one block used as a substitution for a conventional tee, the projecting block being shown slanted in solid lines before being hit by a golf club and in dot and dash lines after being hit.

Four of the blocks 16 are specially prepared in that a slit 17 is cut into one end of each of the blocks 16, thereby freeing it from the wire 13 which normally would pass therethrough. Hence, these projecting blocks 16, as best shown in FIGS. 2 and 3, can be pivoted around one of the wires 13 to upright position.

Preferably in the middle of mat 11 (although not necessarily so) is a tee location 19. A conventional golf tee (not shown) may be inserted in the mat at position 19 and held therein by the blocks 12 which surround the tee. A specially prepared tee 21 is shown in the drawings, particularly in FIG. 2. Such a tee has an enlarged base 22 under mat 11 and a cup-shaped top 23 which supports golf ball 24. The ball 24 may be a conventional golf ball or, if the ball is being hit inside a building, is preferably a special practice ball.

Figure 1:
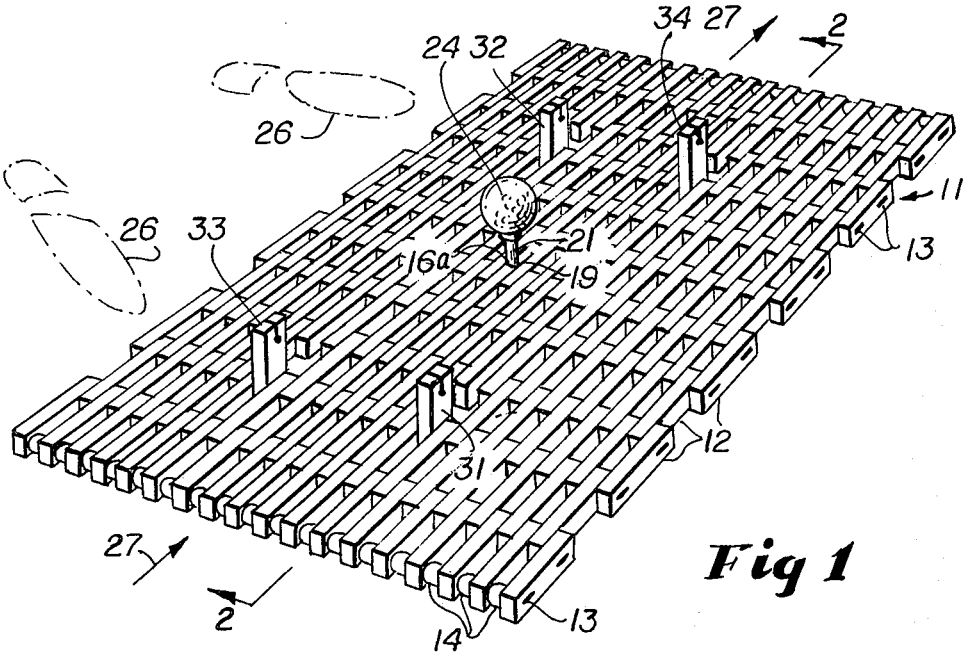
FIG. 1 is a perspective view of a mat modified in accordance with the present invention.

Referring to FIG. 1, 26 indicates the proper location of the feet of the user. The arrows 27 indicate the direction of the stroke.

The outer rear projection 31 and the inner forward projection 32 are preferably colored one color, such as red. The inner rear projection 33 and the outer forward projection 34 are colored a different color, such as yellow.

The golfer swings the club at the ball 24, trying to maintain the swing of the club straight through the ball as indicated by arrows 27. If the swing is such as to be likely to cause a slice, then one or both of the projections 31, 32 will be knocked down or touched. On the other hand, if the swing is such as likely to cause a hook, one or both of the projections 33,34 will be touched. Thus, by observation, the user can determine whether his swing is proper or improper and, if improper, how to correct it.

FIG. 3 shows a modification wherein a conventional tee or the tee of FIG. 2 is not needed. The center block **16*a* of the mat is cut with a slit 17*a*. When used with a tee, center block 16*a* is placed flat, parallel to the ground. However, when no tee is being used, and preferably when the mat is on a firm surface, block 16*a* is raised to about a 30° angle as shown in FIG. 3. The golfer then attempts to swing the club in normal fashion. If the club strikes the block 16*a* in correct manner, block 16*a* rebounds to upright position—dot-and-dash lines as in FIG. 3. This feature of the invention permits use of mat 11** inside or outside, with or without a ball.

What is claimed is:

1. In a golf practice device of the type having a rectangular mat formed of a plurality of rectangular blocks of approximately square cross-section, said blocks being arranged in a plurality of rows, the blocks in each row having their longer dimensions extending longitudinally of said mat, the ends of said adjacent blocks in each row being spaced apart a distance less than the length of said blocks, the blocks in adjacent rows being staggered relative to each other so that at least one side of each block in each row has an overlap area opposed to a corresponding overlap area of a side of a block in an adjacent row, and a plurality of parallel wires extending transversely of said mat and through holes in the overlap areas of one block in each of said rows, said wires retaining said blocks in assembled position, the improvement comprising at least a first said block being formed with a slit in a first end of said first said block extending inward from said first end of said first said block in the plane of said wires and extending inward to one said wire whereby said first block is disengaged from said one said wire and can be pivotted about another said wire extending through a second end of said first said block to an upright position above the plane of the top of said mat.

2. A device according to claim 1 wherein said mat has a tee location for a tee and at least four additional said blocks are formed with slits at first ends of each said additional blocks extending inward from said first ends in the plane of said wires and extending inward to one of said wires whereby said additional blocks are disengaged from said one of said wires and can be individually pivotted about another said wire extending through second ends of said additional blocks to an upright position above the plane of the top of said mat, two of said additional blocks being behind and two ahead of said tee location, two of said additional blocks being on the far side and two on the near side of said tee location.

3. A device according to claim 2 which further comprises a tee at said tee location, said tee having a base below said mat.

4. A device according to claim 1 wherein the centermost of said plurality of blocks is formed with a slit formed in a first end of said centermost block extending inward from a first end of said centermost block in the plane of said wires and extending inward to one said wire whereby said centermost block is disengaged from said one said wire and can be pivotted about another said wire extending through a second end of said centermost block to an upright position above the plane of said mat, to permit pivotting of said centermost block between flat, intermediate and upright positions, whereby said centermost block may be positioned flat when said device is used with a ball or may be turned to intermediate position at about a 30° angle to the mat when said device is not used with a ball so that it may be struck with a golf club, said centermost block rebounding to upright position if it has been struck properly.

* * * * *